US008504251B2

(12) United States Patent
Murota

(10) Patent No.: US 8,504,251 B2
(45) Date of Patent: Aug. 6, 2013

(54) INTERFERENCE PREVENTION CONTROL DEVICE OF A MACHINE

(75) Inventor: Isao Murota, Tokyo (JP)

(73) Assignee: Catepillar SARL, Geneva (CH)

( * ) Notice: Subject to any disclaimer, the term of this patent is extended or adjusted under 35 U.S.C. 154(b) by 203 days.

(21) Appl. No.: 12/866,811

(22) PCT Filed: Jan. 22, 2009

(86) PCT No.: PCT/JP2009/050935

§ 371 (c)(1),
(2), (4) Date: Aug. 9, 2010

(87) PCT Pub. No.: WO2009/104450

PCT Pub. Date: Aug. 27, 2009

(65) Prior Publication Data

US 2011/0264334 A1 Oct. 27, 2011

(30) Foreign Application Priority Data

Feb. 20, 2008 (JP) ..... 2008-038650

(51) Int. Cl.
*G06F 19/00* (2011.01)

(52) U.S. Cl.
USPC ..... 701/50

(58) Field of Classification Search
USPC ..... 701/50; 172/2, 35, 204, 681, 701.1, 172/722, 783, 811; 444/680, 682, 744.1, 444/745.1, 745.2; D15/23
See application file for complete search history.

(56) References Cited

U.S. PATENT DOCUMENTS

2007/0202861 A1* 8/2007 Adachi et al. ..... 455/414.2
2010/0183416 A1* 7/2010 Ishii et al. ..... 414/680

FOREIGN PATENT DOCUMENTS

JP 3310783 B2 8/2002
JP 2004-132077 A 4/2004

* cited by examiner

*Primary Examiner* — Mary Cheung

(57) ABSTRACT

The present invention provides an interference prevention control device of a work machine, wherein the interference prevention control device is capable of limiting movement of a cab based on a position of a tool and thereby preventing interference of the cab with the tool as well as improving the work efficiency of the work machine. A cab position sensor for detecting a position of a movable cab, as well as a boom angle sensor and an arm angle sensor for detecting a position of a tool at the distal end of the work equipment, are connected to a controller. Solenoid-operated directional control valves for limiting movement of a cab lifting cylinder are disposed in pilot passages of a spool of a pilot-operated control valve, and the solenoids of the solenoid-operated directional control valves are connected to the controller. Based on the positional relationship between the position of the cab (cab interference area) detected by the cab position sensor and the position of the tool detected by the boom angle sensor and the arm angle sensor, the controller controls movement of an actuator of the cab by means of the solenoid-operated directional control valves so as to prevent interference between the cab and the tool.

20 Claims, 4 Drawing Sheets

INTERFERENCE PREVENTION CONTROL DEVICE OF A MACHINE

CROSS REFERENCE TO PRIOR APPLICATIONS

This application is a U.S. National Phase application under 35 U.S.C. §371 of International Application No. PCT/JP2009/050935, filed on Jan. 22, 2009 and claims benefit of priority to Japanese Patent Application No. 2008-038650, filed on Feb. 20, 2008. The International Application was published in Japanese on Aug. 27, 2009 as WO 2009/104450 A1 under PCT Article 21(2). All these applications are herein incorporated by reference.

TECHNICAL FIELD

The present invention relates to an interference prevention control device of a work machine provided with a cab that is movably mounted on the machine body.

BACKGROUND ART

With regard to a work machine provided with a cab and a work equipment mounted on the machine body in such a manner that the cab and the work equipment are capable of moving independently of each other, conventional cab interference prevention control for preventing interference between the cab and the work equipment is typically performed by detecting the distance moved by the cab; adjusting the interference prevention range based on the result of the detection of the actual distance moved by the cab in order to prevent interference between the cab and the work equipment; and, based on the adjusted interference prevention range, limiting movement of the work equipment (e.g. see Japanese Patent No. 3,310,783 (pp 4 and 5, and FIGS. 3 to 5).

SUMMARY OF THE INVENTION

The interference prevention control described above moves the cab after putting the work equipment into a stand-by position where the work equipment will not interfere with the cab, adjusts the interference prevention range after moving the cab, and, thereafter, moves the work equipment. Therefore, should the cab be moved when the work equipment is in an intended working position, it may be determined that the cab will interfere with the work equipment. However, preventing such an occurrence by putting the work equipment into a stand-by position where the work equipment will not interfere with the cab each time the cab is moved reduces the work efficiency of the work machine.

In order to solve the above problems, an object of the invention is to provide an interference prevention control device of a work machine, wherein the interference prevention control device is capable of limiting movement of the cab based on a position of the tool of the work equipment and thereby preventing interference of the cab with the tool as well as improving the work efficiency of the work machine.

The present invention relates to an interference prevention control device of a work machine provided with a cab and a work equipment mounted on the machine body in such a manner that the cab and the work equipment are capable of moving independently of each other, the interference prevention control device including a cab position sensor, a tool position sensor, a limiting means, and a controller. The cab position sensor serves to detect a position of the cab. The tool position sensor serves to detect a position of a tool attached to the work equipment. The limiting means serves to limit movement of an actuator that operates to move the cab. The controller serves to determine a positional relationship between the tool and the cab based on the tool position detected by the tool position sensor as well as the cab position detected by the cab position sensor; and, based on the positional relationship, control the movement of the actuator of the cab by means of the limiting means so as to prevent interference between the cab and the tool.

According to the present invention, the actuator that has had its movement limited by the limiting means of the interference prevention control device of the work machine according to Claim 1 of the present invention is a hydraulic actuator that has had its movement controlled by a pilot-operated control valve, and the limiting means is a solenoid-operated directional control valve disposed in a pilot passage of the pilot-operated control valve.

According to the present invention, the controller of the interference prevention control device of the work machine according to the invention is adapted to output a signal commanding maximum operation to the solenoid-operated directional control valve in cases where the controller determines, based on the positional relationship between the tool and the cab, that movement of the cab by a given amount will cause no interference of the cab with the tool, and output a command signal corresponding to the positional relationship in cases where the controller predicts interference.

According to the present invention, the controller determines a positional relationship between the tool of the work equipment and the cab based on a tool position detected by the tool position sensor as well as a cab position detected by the cab position sensor; and, based on the positional relationship, controls the movement of the actuator of the cab by means of the limiting means. As a result, interference of the cab with the tool of the work equipment can be prevented by limiting the movement of the cab in accordance with the position of the tool when the cab approaches the tool. Furthermore, as priority is given to movement of the work equipment while the cab can be moved as intended within a permissible range, the work efficiency can be improved.

According to the present invention, the limiting means is a solenoid-operated directional control valve disposed in a pilot passage of a pilot-operated control valve that serves to control movement of a hydraulic actuator. Therefore, it is possible to control the movement of the hydraulic actuator with a high degree of accuracy and thereby reliably prevent interference between the tool of the work equipment and the cab.

According to the present invention, in cases where the controller determines, based on the positional relationship between the tool and the cab, that movement of the cab by a given amount will cause no interference of the cab with the tool, the controller outputs a signal commanding maximum operation to the solenoid-operated directional control valve, thereby ensuring high-speed operation of the cab with high work efficiency. In cases where the controller predicts interference, the controller outputs a command signal corresponding to the positional relationship to the solenoid-operated directional control valve, thereby reducing the cab speed as the cab approaches the tool, leading to shock-free, smooth stoppage of the cab.

DETAILED DESCRIPTION OF THE INVENTION

Next, the present invention is explained in detail hereunder, referring to an embodiment thereof shown in the attached drawings.

Figure 2:
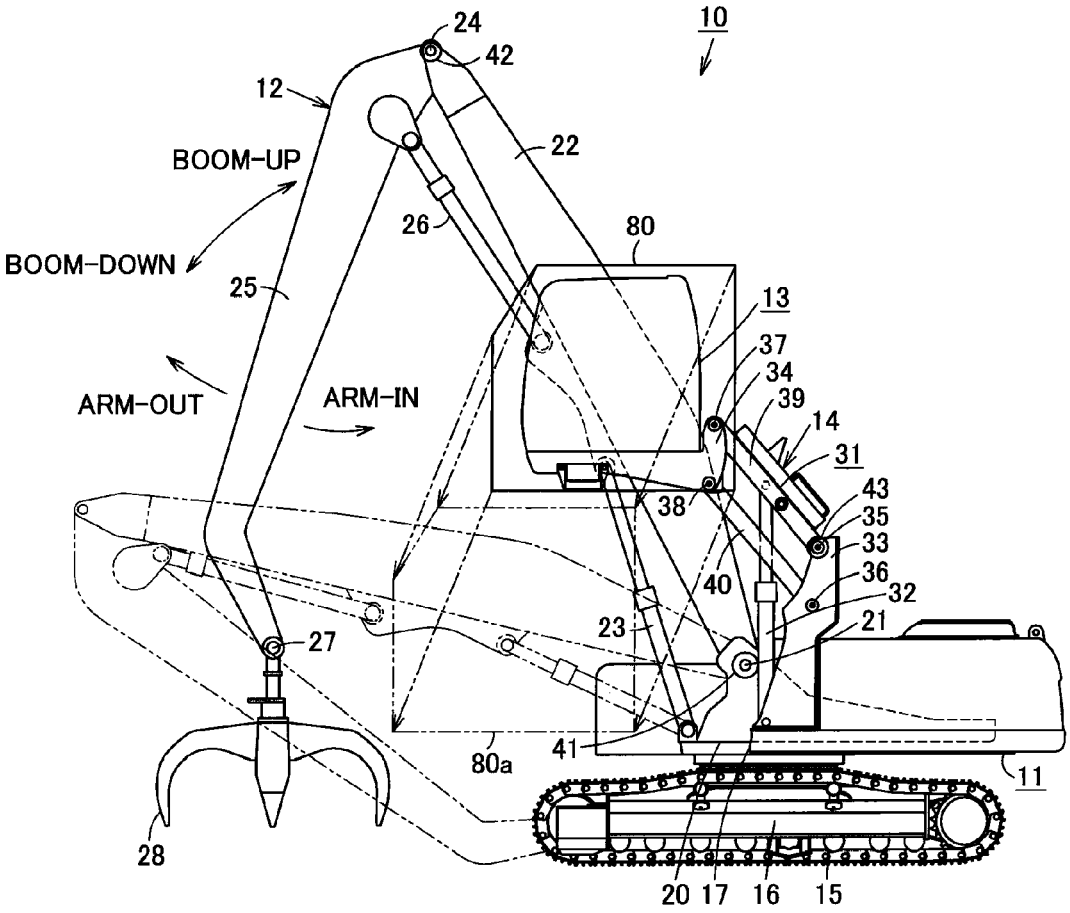
FIG. 2 is a side view of a work machine equipped with the interference prevention control device.

FIG. 2 illustrates a work machine 10. A front work equipment 12 serving as a work equipment is mounted on the machine body 11 of the work machine 10. At a side of the front work equipment 12, a cab 13 is mounted on the machine body 11 so as to be capable of being lifted above and lowered towards the machine body 11. A cab moving device 14 for lifting and lowering the cab 13 is provided between the cab 13 and the machine body 11. The machine body 11 includes a lower structure 16 equipped with crawler belts 15, and an upper structure 17 rotatably mounted on the lower structure 16.

The front work equipment 12, which is mounted on the machine body 11 together with the cab 13, includes a boom 22, the base end of which is pivotally supported at a swiveling frame 20 of the machine body 11 by a shaft and a boom foot pin 21. A boom cylinder 23 is provided between the swiveling frame 20 and the boom 22 and serves as an actuator for vertically pivoting the boom 22. The base end of an arm 25 is pivotally supported at the distal end of the boom 22 by a shaft and a boom end pin 24. An arm cylinder 26 is provided between the boom 22 and the arm 25 and serves as an actuator for pivoting the arm 25. A tool 28 is supported at the distal end of the arm 25 by a shaft and an arm end pin 27.

The tool 28 shown in the drawing is a grapple, which is used for demolition or other similar operations. As the grapple is driven to be opened or closed by a tool actuator (not shown) so as to grasp or release a workpiece, the diameter of the grapple changes. Other examples of the tool include a clamshell bucket, a magnet, a fork, and the like.

The cab moving device 14 includes a link mechanism 31 and a cab lifting cylinder 32. The link mechanism 31 serves to maintain the cab 13 at a prescribed attitude. The cab lifting cylinder 32 serves as an actuator for lifting or lowering the cab 13.

The link mechanism 31 includes a support tower body 33, an L-shaped link connecting portion 34, an upper link 39, and a lower link 40. The support tower body 33 is provided, in an upright position, on the upper structure 17 of the machine body 11. The link connecting portion 34 is formed at the lower part of the cab 13 as an integral body with the cab 13. The upper link 39 and the lower link 40 are disposed between and pivotally connected to the upper part of the support tower body 33 and the back end of the link connecting portion 34 by means of pins 35,36,37,38 so that the upper link 39 and the lower link 40 are constantly maintained parallel to each other. The upper link 39 and the lower link 40 are adapted to be vertically pivoted by the cab lifting cylinder 32.

The base end of the cab lifting cylinder 32 is pivotally supported at the lower part of the support tower body 33 by a shaft and a pin. The cab lifting cylinder 32 has a piston rod, the distal end of which is pivotally connected to the upper link 39 by a pin.

As described above, the cab 13 can be lifted or lowered by the cab moving device 14. The front work equipment 12 includes the boom 22, which is attached to the machine body 11 so as to be capable of pivoting around the boom foot pin 21 by the boom cylinder 23; the arm 25, which is attached to the boom 22 so as to be capable of pivoting around the boom end pin 24 by the arm cylinder 26; and tool 28, which is attached to the arm 25 so as to be capable of pivoting around the arm end pin 27.

A boom angle sensor 41 for detecting an angle of the boom 22 with respect to the swiveling frame 20 is attached to an end of the boom foot pin 21, and an arm angle sensor 42 for detecting an angle of the arm 25 with respect to the boom 22 is attached to an end of the boom end pin 24. The boom angle sensor 41 and the arm angle sensor 42 together serve as a tool position sensor for detecting a position of the tool 28 attached to the front work equipment 12. A cab position sensor 43 for detecting a position of the cab 13 by detecting an angle of the upper link 39 with respect to the support tower body 33 is attached to an end of the pin 35. Examples of devices that can be used as the boom angle sensor 41, the arm angle sensor 42, or the cab position sensor 43 include a rotary potentiometer.

Figure 1:
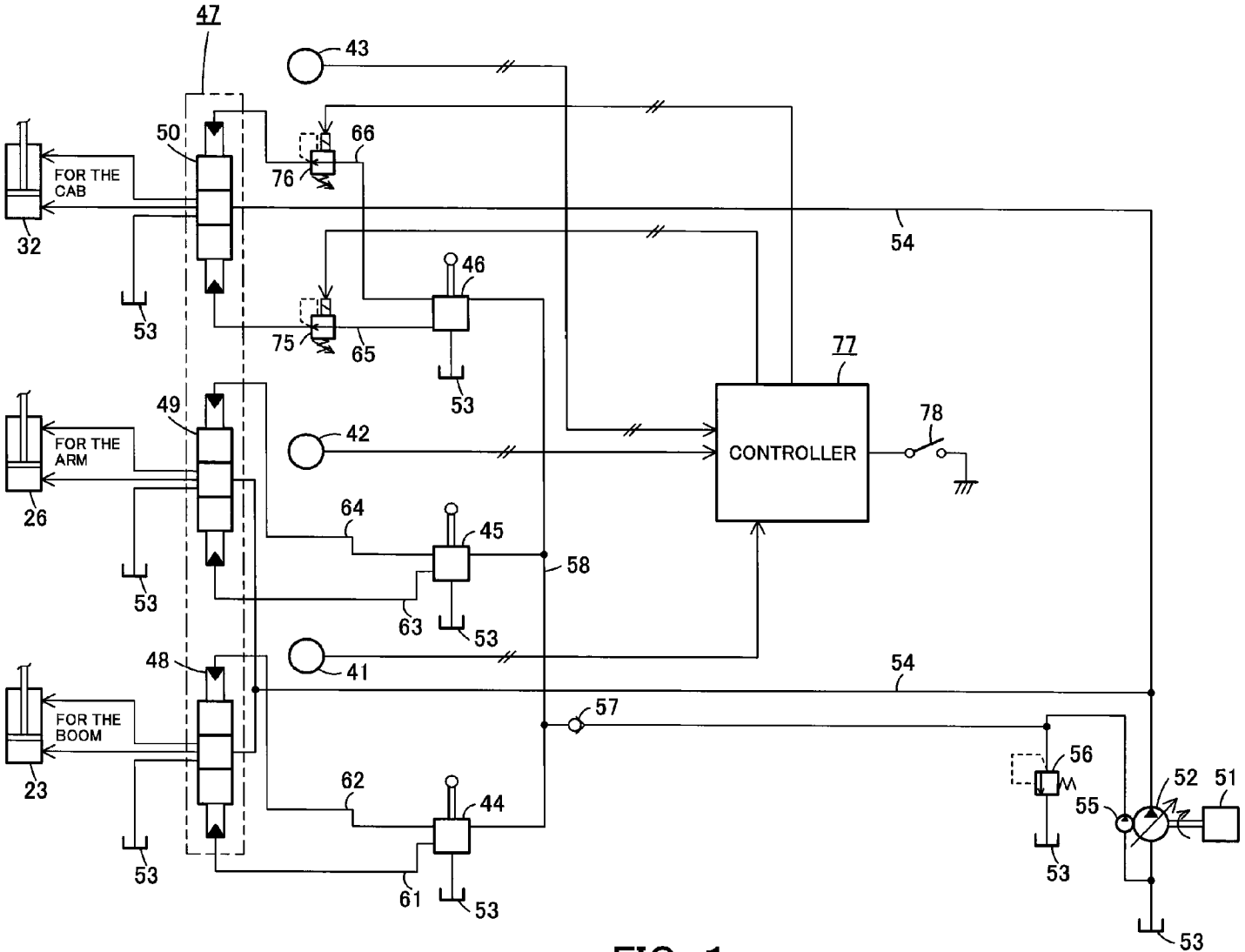
FIG. 1 is a control circuit diagram showing an interference prevention control device of a work machine according to an embodiment of the present invention.

FIG. 1 illustrates a control circuit for controlling the cylinders. An operation unit provided with operation valves 44,45,46 is installed in the cab 13 and adapted to be operated by an operator seated in the seat. The machine body 11 is provided with travel motors (not shown in the drawings) mounted on the lower structure 16, a swivel motor (not shown) for swiveling the upper structure 17 on the lower structure 16, and a pilot-operated control valve 47 for controlling hydraulic actuators, such as the boom cylinder 23, the arm cylinder 26, and the cab lifting cylinder 32.

The pilot-operated control valve 47 includes, at least, spools 48,49,50 for controlling the boom cylinder 23, the arm cylinder 26, and the cab lifting cylinder 32, respectively.

The spools 48,49,50 have a function of controlling the direction and flow rate of hydraulic oil fed respectively to the boom cylinder 23, the arm cylinder 26, and the cab lifting cylinder 32 and returning the return oil into a tank 53. To be more specific, when a motor 51, which may be an on-vehicle engine, drives a main pump 52 so that the hydraulic oil is fed from the tank 53 to the spools 48,49,50 through a main passage 54, each spool 48,49,50 controls, based on its stroke position, the direction and flow rate of the hydraulic oil fed therefrom to the corresponding actuator, i.e. the boom cylinder 23, the arm cylinder 26, or the cab lifting cylinder 32, and returns the return oil into the tank 53.

A pilot pump 55 is provided and driven together with the main pump 52 by the motor 51. The pilot pump 55 serves to feed pressurized pilot oil at a pilot primary pressure, which is set at a relief valve 56, to the operation valves 44,45,46 through a primary pressure passage 58 provided with a check valve 57. The operation valves 44,45,46 feed pilot secondary pressures to pilot operation units of the respective spools 48,49,50 through secondary pressure passages 61,62,63,64,65,66, which serve as pilot passages. The amounts of pilot secondary pressures respectively correspond to the degrees of operation of the levers.

Solenoid-operated directional control valves 75,76 serving as a limiting means are disposed in the secondary pressure passages 65,66 to the cab. These solenoid-operated directional control valves 75,76 are provided with solenoids, which are connected to an output section of a controller 77. The aforementioned boom angle sensor 41, arm angle sensor 42, and cab position sensor 43, as well as a switch 78 for initiating interference prevention control, are connected to an input section of the controller 77.

Based on the position of the cab 13 detected by the cab position sensor 43 (the position of the cab 13 hereinafter means the position of a cab interference area 80 set around the cab 13) and the position of the tool 28 detected by the boom angle sensor 41 and the arm angle sensor 42, the controller 77 determines the positional relationship between the tool 28 and the cab 13, and, based on the positional relationship, controls the movement of the actuator of the cab 13 through the solenoid-operated directional control valves 75,76 so as to prevent interference between the cab 13 and the tool 28.

Figure 3:
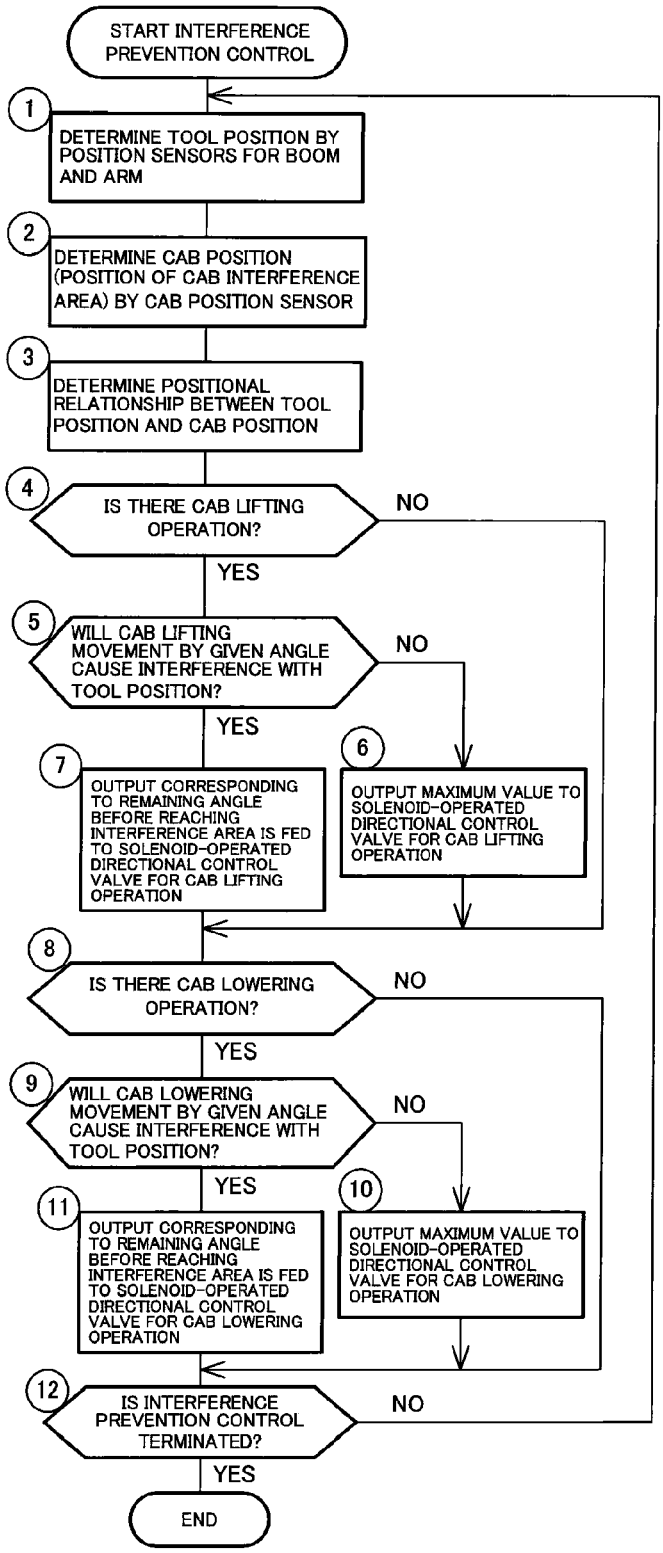
FIG. 3 is a flow chart showing the details of interference prevention control performed by a controller of the interference prevention control device.

Next, interference prevention control performed by the controller 77 is explained hereunder, referring to the flow chart illustrated in FIG. 3, wherein numerals enclosed with circles represent step numbers showing control procedures.

(Step 1)

The boom angle and the arm angle are detected by means of the boom angle sensor 41 and the arm angle sensor 42, and the coordinates of the distal end of the arm, i.e. the position of the tool 28, are determined based on the boom angle and the arm angle as well as the boom length and the arm length, which are already known.

(Step 2)

The position of the cab 13, in other words the position of the cab interference area 80, is determined by detecting the angle of the link mechanism 31 by means of the cab position sensor 43.

(Step 3)

The positional relationship between the tool position and the cab position is determined.

(Step 4)

Whether or not there is a cab lifting command is determined. If there is no cab lifting command, the process proceeds to Step 8.

(Step 5)

If a cab lifting command is ascertained, whether or not a given amount of cab lifting movement, in other words moving the cab upward by a given angle, will cause interference of the computed position 80*a* of the cab interference area 80 with the position of the tool 28 is determined.

(Step 6)

If it is ascertained that the cab lifting movement by the given angle will not cause the computed position 80*a* of the cab interference area 80 to interfere with the position of the tool 28, a signal commanding maximum operation is output to the solenoid-operated directional control valve 76 for cab lifting operation so that the solenoid-operated directional control valve 76 is controlled to be in a fully open state. As a result, it is ensured that the cab can be lifted at a speed corresponding to the degree of operation of the operation valve 46, because the cab lifting pilot secondary pressure from the operation valve 46 is not limited.

(Step 7)

Figure 4:
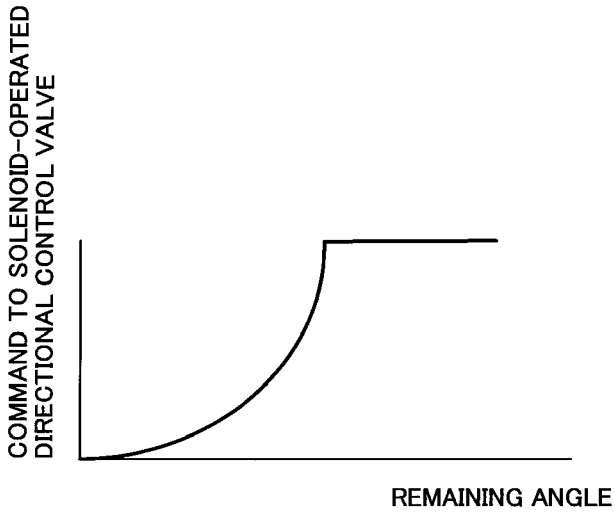
FIG. 4 is a characteristic diagram showing characteristics of command signals output from the controller of the interference prevention control device to a solenoid-operated directional control valve.

If it is ascertained that the cab lifting movement by the given angle will cause the computed position 80*a* of the cab interference area 80 to interfere with the position of the tool 28, a command signal corresponding to the remaining angle from the position of the tool 28 to the cab interference area 80 is output to the solenoid-operated directional control valve 76 for cab lifting operation. As a result, even if the cab lifting pilot secondary pressure has been generated in the amount corresponding to the degree of operation of the operation valve 46, the commanding signal output from the controller 77 to the solenoid-operated directional control valve 76 is gradually reduced in proportion to the decrease in the remaining angle as illustrated in FIG. 4 so that the cab lifting pilot secondary pressure is gradually reduced, ultimately to zero, by means of the solenoid-operated directional control valve 76, regardless of the degree of operation of the operation valve 46.

(Step 8)

Whether or not there is a cab lowering command is determined. If there is no cab lowering command, the process proceeds to Step 12.

(Step 9)

If a cab lowering command is ascertained, whether or not cab lowering movement by a given angle will cause interference of the computed position 80*a* of the cab interference area 80 with the position of the tool 28 is determined.

(Step 10)

If it is ascertained that the cab lowering movement by the given angle will not cause the computed position 80*a* of the cab interference area 80 to interfere with the position of the tool 28, a signal commanding maximum operation is output to the solenoid-operated directional control valve 75 for cab lowering operation so that the solenoid-operated directional control valve 75 is controlled to be in a fully open state. As a result, it is ensured that the cab can be lowered at a speed corresponding to the degree of operation of the operation valve 46, because the cab lowering pilot secondary pressure from the operation valve 46 is not limited.

(Step 11)

If it is ascertained that the cab lowering movement by the given angle will cause the computed position 80*a* of the cab interference area 80 to interfere with the position of the tool 28, a command signal corresponding to the remaining angle from the position of the tool 28 to the cab interference area 80 is output to the solenoid-operated directional control valve 75 for cab lowering operation. As a result, even if the cab lowering pilot secondary pressure has been generated in the amount corresponding to the degree of operation of the operation valve 46, the commanding signal output from the controller 77 to the solenoid-operated directional control valve 75 is gradually reduced in proportion to the decrease in the remaining angle as illustrated in FIG. 4 so that the cab lowering pilot secondary pressure is gradually reduced, ultimately to zero, by means of the solenoid-operated directional control valve 75, regardless of the degree of operation of the operation valve 46.

(Step 12)

Whether or not the interference prevention control has been terminated is determined by ascertaining whether the switch 78 is on or off. Throughout the period when interference prevention control continues, the process keeps returning to Step 1.

As described above, according to the example of a control method illustrated in FIG. 3, the controller 77 always grasps the cab position detected by the cab position sensor 43 attached to the cab moving device 14, as well as the tool position that is computed based on the attitude of the front work equipment detected by the boom angle sensor and the arm angle sensor 42, which are respectively attached to joints of the front work equipment 12. The controller 77 performs cab interference prevention control by thus monitoring the positional relationship between the cab 13 and the tool 28 constantly so that whenever the cab 13 being moved approaches the tool 28, the controller 77 commands the solenoid-operated directional control valves 75,76 to limit output to the cab lifting cylinder 32 of the cab moving device 14, which is in the process of moving the cab 13.

Next, functions and effects of the embodiment described above are explained.

According to the interference prevention control illustrated in FIGS. 1 to 3, the position of the tool 28 of the front work equipment 12 is detected by the boom angle sensor 41 and the arm angle sensor 42, which together serve as the tool position sensor, and the position of the cab interference area 80 is detected by the cab position sensor attached to the cab moving device 14. Then, the controller 77 determines the positional relationship between the tool 28 and the cab 13 based on the detected positions of the tool 28 and the cab interference area 80; and, based on the positional relationship, controls the solenoid-operated directional control valves 75,76 so as to limit the movement of the cab lifting cylinder 32, which is an actuator of the cab 13, independently of operation by the operator. As a result, interference of the cab 13 with the tool 28 of the front work equipment 12 can be prevented by limiting the movement of the cab 13 in accordance with the position of the tool 28 when the cab 13 approaches the tool 28. Furthermore, as the interference prevention control according to the invention gives priority to movement of the front work equipment 12 while enabling the cab 13 to be moved as intended within a permissible range, the work efficiency can be improved.

In the control circuit illustrated in FIG. 1, the limiting means is composed of the solenoid-operated directional control valves 75,76 disposed in the secondary pressure passages 65,66 connected in fluid communication with the pilot operation unit of the spool 50 of the pilot-operated control valve 47, which controls movement of the cab lifting cylinder 32. Therefore, the control circuit is capable of controlling the movement of the hydraulic actuators with a high degree of accuracy and thereby reliably preventing interference between the tool 28 of the front work equipment 12 and the cab 13.

As illustrated in FIG. 4, in cases where the controller 77 determines that no interference will occur between the tool 28 of the front work equipment 12 and the cab 13, even if the boom, the arm or the cab is moved by the given amount, i.e. by the given angle, in other words, in cases where the remaining angle is large, the controller outputs a signal commanding maximum operation to the appropriate one of the solenoid-operated directional control valves 75,76, thereby ensuring high-speed operation with high work efficiency. In cases where the controller 77 predicts interference, in other words in cases where the remaining angle is small, the controller 77 outputs a command signal corresponding to the positional relationship between the tool 28 and the cab 13 to the solenoid-operated directional control valve 75 or 76, thereby reducing the operation speed as the tool 28 and the cab 13 approach each other, leading to shock-free, smooth stoppage.

The present invention is applicable to a work machine equipped with a movable cab.

The invention claimed is:

1. An interference prevention control device of a machine having a machine body and provided with a cab and a work equipment mounted on the machine body in such a manner that the cab and the work equipment are capable of moving independently of each other, the interference prevention control device comprising:

a cab position sensor for detecting a position of the cab;

a tool position sensor for detecting a position of a tool attached to the work equipment;

a limiter configured to limit movement of a hydraulic actuator that serves to move the cab;

a main pump fluidly coupled to the hydraulic actuator and configured to provide pressurized fluid to the hydraulic actuator to move the cab relative to the machine body;

a pilot pump configured to provide pressurized pilot fluid for controlling the supply of pressurized fluid from the main pump to the hydraulic actuator; and a controller that serves to:

determine a positional relationship between the tool and the cab based on the tool position detected by the tool position sensor as well as the cab position detected by the cab position sensor; and based on the positional relationship, control the movement of the hydraulic actuator of the cab by means of the limiter so as to prevent interference between the cab and the tool.

2. An interference prevention control device of a machine as claimed in claim 1, wherein:

the hydraulic actuator that has had movement thereof limited by the limiter is a hydraulic actuator that has had movement thereof controlled by a pilot-operated control valve; and the limiter is a solenoid-operated directional control valve disposed in a pilot passage of the pilot-operated control valve.

3. An interference prevention control device of a machine as claimed in claim 2, wherein the controller is adapted to:

output a signal commanding maximum operation to the solenoid-operated directional control valve in cases where the controller determines, based on the positional relationship between the tool and the cab, that movement of the cab by a given amount will cause no interference of the cab with the tool; and output a command signal corresponding to the positional relationship in cases where the controller predicts interference.

4. The interference prevention control device of claim 1, wherein the cab is mounted on the machine body so as to be capable of being lifted above and lowered towards the machine body.

5. The interference prevention control device of claim 4, further including a cab moving device for lifting and lowering the cab, the cab moving device being provided between the cab and the machine body.

6. The interference prevention control device of claim 2, wherein the hydraulic actuator is configured to control movement of a link mechanism connected between the cab and the machine body.

7. The interference prevention control device of claim 6, wherein the link mechanism includes a support tower body provided on the machine body and a pair of links pivotally connected to an upper portion of the support tower body.

8. The interference prevention control device of claim 2, wherein the pilot pump is fluidly coupled to the pilot passage of the pilot-operated control valve.

9. The interference prevention control device of claim 8, further including an operation valve disposed in the pilot passage between the pilot pump and the pilot-operated control valve.

10. The interference prevention control device of claim 1, further including:

a second hydraulic actuator connected between the work equipment and the machine body, movement of the second hydraulic actuator being controlled by a pilot-operated control valve.

11. The interference prevention control device of claim 10, further including:

the main pump fluidly coupled to the second hydraulic actuator and configured to provide pressurized fluid to the second hydraulic actuator to move the work equipment relative to the machine body; and the pilot pump fluidly coupled through a pilot passage to the pilot-operated control valve.

12. The interference prevention control device of claim 11, further including:

an operation valve disposed in the pilot passage between the pilot pump and the pilot-operated control valve.

13. A method of preventing interference between a cab and a work tool mounted on a machine having a machine body wherein the cab and the work tool are capable of moving independently of each other, the method comprising:

detecting a position of the cab;

detecting a position of the tool;

determining a positional relationship between the tool and the cab based on the position of the cab and the position of the tool;

providing pressurized fluid to a hydraulic actuator configured to move the cab relative to the machine body;

providing pressurized pilot fluid for controlling the supply of pressurized fluid to the hydraulic actuator; and limiting movement of the hydraulic actuator configured to move the cab based on the positional relationship between the tool and the cab so as to prevent interference between the cab and the tool.

14. The method of claim 13, wherein limiting movement of the actuator is controlled by a pilot-operated control valve interposed in a fluid passageway between a main pump and the hydraulic actuator.

15. The method of claim 14, wherein the pilot-operated control valve is controlled by a solenoid-operated directional control valve disposed in a pilot passage of the pilot-operated control valve.

16. The method of claim 15, further including:

commanding maximum operation of the solenoid-operated directional control valve in cases where movement of the cab will cause no interference of the cab with the tool; and commanding operation of the solenoid-operated directional control valve corresponding to the positional relationship between the tool and the cab in cases where movement of the cab will cause interference with the tool.

17. The method of claim 15, wherein a pilot pump separate from the main pump provides fluid pressure to the pilot passage of the pilot-operated control valve.

18. The method of claim 17, wherein an operation valve interposed between the pilot pump and the pilot-operated control valve controls flow from the pilot pump to the pilot-operated control valve.

19. The method of claim 18, wherein a solenoid-operated directional control valve interposed between the operation valve and the pilot-operated control valve controls flow from the pilot pump to the pilot-operated control valve independently from operation of the operation valve.

20. A machine, comprising:

a machine body;

a cab mounted on the machine body;

a cab moving device connected between the cab and the machine body and including a link mechanism and a cab lifting cylinder;

a work equipment mounted on the machine body and capable of moving relative to the machine body independently from movement of the cab relative to the machine body;

a tool attached to the work equipment;

a main pump fluidly coupled to at least the cab lifting cylinder and configured to provide pressurized fluid to the cab lifting cylinder to move the cab relative to the machine body;

a pilot-operated control valve disposed between the main pump and at least the cab lifting cylinder;

a pilot pump fluidly coupled to a pilot passage of the pilot-operated control valve; and an interference prevention control device comprising:

a cab position sensor for detecting a position of the cab;

a tool position sensor for detecting a position of the tool;

a limiter configured to limit movement of the cab lifting cylinder; and a controller configured to:

determine a positional relationship between the tool and the cab based on the tool position detected by the tool position sensor as well as the cab position detected by the cab position sensor; and based on the positional relationship, control the movement of the cab lifting cylinder by means of the limiter so as to prevent interference between the cab and the tool.

* * * * *